US009939116B2

(12) United States Patent
Li

(10) Patent No.: US 9,939,116 B2
(45) Date of Patent: Apr. 10, 2018

(54) LED ILLUMINATION DEVICE CAPABLE OF DISASSEMBLING, ASSEMBLING, COMBINING AND SLIDABLY ADJUSTING MODULES, AND CONTROL METHOD

(71) Applicant: SHENZHEN XINGRISHENG INDUSTRIAL CO., LTD., Shenzhen, Guangdong Province (CN)

(72) Inventor: Xiuqi Li, Shenzhen (CN)

(73) Assignee: SHENZHEN XINGRISHENG INDUSTRIAL CO., LTD. (CN)

( * ) Notice: Subject to any disclaimer, the term of this patent is extended or adjusted under 35 U.S.C. 154(b) by 291 days.

(21) Appl. No.: 14/785,472

(22) PCT Filed: Apr. 19, 2013

(86) PCT No.: PCT/CN2013/074475
§ 371 (c)(1),
(2) Date: Oct. 19, 2015

(87) PCT Pub. No.: WO2014/169491
PCT Pub. Date: Oct. 23, 2014

(65) Prior Publication Data

US 2016/0069519 A1 Mar. 10, 2016

(51) Int. Cl.
*F21K 99/00* (2016.01)
*F21V 21/35* (2006.01)
(Continued)

(52) U.S. Cl.
CPC ..... *F21K 9/30* (2013.01); *F21K 9/20* (2016.08); *F21K 9/27* (2016.08); *F21S 8/046* (2013.01); *F21V 21/35* (2013.01); *F21Y 2115/10* (2016.08)

(58) Field of Classification Search
CPC ..... F21K 9/30; F21K 9/20; F21K 9/27; F21S 8/046; F21V 21/35; F21Y 2115/10
See application file for complete search history.

(56) References Cited

U.S. PATENT DOCUMENTS 6,998,650 B1 * 2/2006 Wu ..... F21K 9/00 257/100
2003/0063463 A1 * 4/2003 Sloan ..... F21V 21/0808 362/238

(Continued)

*Primary Examiner* — Mary Ellen Bowman
(74) *Attorney, Agent, or Firm* — PROI Intellectual Property US

(57) ABSTRACT

An LED illumination device capable of disassembling, assembling and combining modules and slidably adjusting locations of modules, and corresponding control method for LED modules. The illumination device comprises a housing and LED modules. At least one slideway is arranged in the housing. The LED modules are removably arranged in any location in any slideways, the device can quickly realize multiple illumination solutions of changing luminance and illuminant colors, so that the LED illumination device can be conveniently applied to various operating environments and can be freely converted in the solutions of applying to various operating environments. Moreover, the control method for the LED modules can implement flexible and varied control on each LED module via an electrode orbit so that the LED illumination device can realize multiple preset illumination solutions, thereby achieving a landscape illumination effect.

20 Claims, 5 Drawing Sheets

(51) Int. Cl.

| | |
|---|---|
| ***F21S 8/04*** | (2006.01) |
| ***F21K 9/20*** | (2016.01) |
| ***F21K 9/27*** | (2016.01) |
| *F21Y 115/10* | (2016.01) |

(56) References Cited

U.S. PATENT DOCUMENTS

2007/0285949 A1* 12/2007 Lodhie ..... F21S 8/038
362/648
2008/0192462 A1* 8/2008 Steedly ..... F21V 19/0055
362/218
2010/0271834 A1* 10/2010 Muessli ..... F21V 21/35
362/398
2015/0330584 A1* 11/2015 Bobbo ..... F21V 15/013
362/220

* cited by examiner

LED ILLUMINATION DEVICE CAPABLE OF DISASSEMBLING, ASSEMBLING, COMBINING AND SLIDABLY ADJUSTING MODULES, AND CONTROL METHOD

CROSS-REFERENCE TO RELATED APPLICATION

This Application is a Section 371 National Stage Application of International Application No. PCT/CN2013/074475, filed Apr. 19, 2013 and published as WO 2014/169491 on Oct. 23, 2014, not in English, the contents of which are hereby incorporated by reference in their entirety.

TECHNICAL FIELD

The invention relates to an LED illumination device as well as its illumination control method, especially a modularized illumination device as well as its illumination control method.

BACKGROUND ART

Most LED lamps with the prior art are fixedly mounted to the fixtures. If luminance and illuminant color are required to be changed or lighting direction is required to be adjusted, the LED lamp shall be replaced integrally, or illumination angle of the LED lamp shall be adjusted integrally, with complex operation and high replacement cost.

As to the prior art, there is also an LED illumination device comprising more than 2 LED illumination modules, which are electrically connected in groups. Via a cycle control switch or several independent switches, LED illumination modules are lightened up by various ways of combination, so as to achieve the effect of adjusting luminance or illuminant color. The said cycle control switch refers to a switching element respectively connected to multiple groups of load, enabling each group of load to start operation in sequence by controlling on-off action continuously. However, for the aforesaid LED illumination device with the prior art, on-off operation is complicated, combination of the LED illumination modules is singular; moreover, LED illumination modules can only be adjusted by means of re-connection of wires, which is complicated and unsafe, and shall be carried out by professionals, bringing inconvenience for users.

CONTENT OF THE INVENTION

The invention is intended to solve the technical issues by avoiding the deficiencies of the prior art, so as to provide an LED illumination device capable of disassembling, assembling and combining modules and slidably adjusting locations of modules, and a corresponding control method for each module of the LED illumination device, so as to enable the operations such as changing the luminance and illuminant color and adjusting the lighting position to be more convenient and efficient, and realize preset illumination solutions.

The invention can solve the said technical issues with the following technical proposals:

Design and manufacture an LED illumination device capable of disassembling, assembling and combining modules and slidably adjusting locations of modules, especially the LED illumination device comprises a housing and at least one LED module installed in the housing. The said LED module is arranged with at least one LED illuminant inside. At least one slideway is arranged in the housing. The said LED module is removably arranged in any location in any slideway, and can conduct sliding movement optionally in the said slideway.

To enable the LED modules to realize multiple illumination solutions, the said housing comprises $N_i$ electrode orbits made of conductive material configured respectively for each slideway, the said $N_i$ represents the quantity of electrode orbit configured for the $i^{th}$ slideway, i is the corresponding serial number configured for each slideway, and $N_i$ is the natural number no smaller than 1. The said LED module is arranged with M sliding contact electrodes which are electrically connected to the LED luminescent lamp body, M is the natural number no smaller than 1. The said sliding contact electrodes stretch out from the LED module. When the LED module is installed in the $P^{th}$ slideway, P is the serial number of a specific slideway, sliding contact electrodes of the LED module are electrically contacted with the electrode orbits configured for the $P^{th}$ slideway. In addition, when the LED module conducts sliding movement in the said $P^{th}$ slideway, the said sliding contact electrodes also maintain electrically contacted sliding movement on the said corresponding electrode orbits configured for the $P^{th}$ slideway along with the LED module.

Specifically, the said electrode orbits can be arranged on the interior surface of the housing.

In addition, the said electrode orbits can also be arranged in the slideway where the electrode orbits belong. And then, the said electrode orbits are arranged on the interior surface of the housing.

To realize power supply to the LED module in the process of sliding in the slideway, the said LED illumination device further comprises a power supply unit which can provide electric energy. The power supply unit is electrically connected to each electrode orbit, so as to provide electric energy to each LED module. On this basis, to control the LED module, the said LED module further comprises a sub control module, the sub control module receives and dispatches control instruction data towards each LED illuminant in the LED module.

In addition, electrode orbits can be utilized to transmit electric energy and control signals simultaneously. The said LED illumination device further comprises a power supply unit providing electric energy, as well as a control unit controlling each LED module. The said electrode orbits are electrically connected to the said power supply unit and control unit, where the former provides electric energy to each LED module by virtue of electrode orbits, while the latter receives and dispatches control instruction data towards each LED illuminant in the LED module.

An available concrete structure of the said LED module shall be that: the said LED module further comprises a printed circuit board, both the LED illuminants and sliding contact electrodes of the LED module are electrically connected to the said printed circuit board.

Specifically, the said LED module further comprises a module lampshade and a module backboard. The said printed circuit board is fixedly mounted to the module backboard. The said module lampshade covers and is connected to the module backboard. The said sliding contact electrodes stretch out of the LED module from the module backboard by virtue of the electrode through hole on the module backboard.

To enable the module backboard to be connected to the module lampshade, top face of the said module backboard is arranged with at least one connecting bracket, and top of the connecting bracket is arranged with a latch hook which stretches out from the outside face of the connecting bracket. Inner wall of the said module lampshade is arranged with straight lock tongues whose quantity is the same with that of the connecting bracket. The said connecting bracket is flexibly connected to the module backboard, or the said connecting bracket is made of elastic material. When the module lampshade covers the module backboard, the latch hooks and lock tongues of the corresponding positions are buckled together under the action of elastic restoring force, thus the module lampshade is connected to the module backboard.

As the specific way of emitting light from the LED module, the said module lampshade is arranged with light inlet windows corresponding to each LED illuminant, thus, light sent out from each LED illuminant shoots out from the LED module from the respectively corresponding light inlet window.

Specifically, the said slideway comprises two slideway vertical walls parallel to each other. The slideway vertical wall is arranged with a concave chute. Notch of the respective chute of the two slideway vertical walls are arranged face to face. The said LED module is arranged with two straight flanges protruding out from the outer wall of the LED module, and the two straight flanges are parallel to each other. The said two straight flanges are arranged respectively corresponding to the said chutes, enabling the LED module to be removably loaded into the slideway by virtue of the two flanges clamped into the two chutes, and enabling the LED module to slidably shift in the slideway by virtue of the two flanges sliding in the two chutes.

More specifically, both the said two slideway vertical walls are connected to the inner face of the housing.

The available concrete structure of the said LED module shall be that, the said LED module further comprises a module backboard as well as a module lampshade covers and connected to the module backboard. The said two flanges are respectively arranged at the two side faces of the module lampshade.

The other available concrete structure of the said LED module shall be that, the said LED module further comprises a module backboard, a module lampshade covers and connected to the module backboard as well as a handle. The said handle is flexibly connected to the said module lampshade or the said handle is made of flexible material. One flange is arranged at the lateral surface of the handle, while the other flange is arranged at the side face of the module lampshade, and the two flanges are ensured to be parallel to each other. The LED module is removably mounted into the slideway by virtue of the elastic restoring force acting on the handle, as well as the two flanges that can be respectively clamped into the two chutes.

As to the handle, it shall comprise an elastic action handle of curved surface and a planar handheld face. One side edge of the said elastic action handle is connected to the module lampshade, while the other side edge of the elastic action handle is connected to the said handheld face. One flange of the said two flanges parallel to each other is arranged at the side face of the elastic action handle facing outside of the LED module. The said elastic action handle is flexibly connected to the said module lampshade, or the said elastic action handle is made of elastic material. Thus, when the LED module is disassembled and assembled in the slideway, the flange arranged on the elastic action handle can be displaced flexibly, restorably and back and forth between the module lampshade and slideway vertical walls.

To enable the module backboard to be connected to the module lampshade, top face of the said module backboard is arranged with at least one connecting bracket, and top of the connecting bracket is arranged with a latch hook which stretches out from the outside face of the connecting bracket. Inner wall of the said module lampshade is arranged with straight lock tongues whose quantity is the same with that of the connecting bracket. The said connecting bracket is flexibly connected to the module backboard, or the said connecting bracket is made of elastic material. When the module lampshade covers the module backboard, the latch hooks and lock tongues of the corresponding positions are buckled together under the action of elastic restoring force, thus the module lampshade is connected to the module backboard.

As the specific way of emitting light from the LED module, the said module lampshade is arranged with light inlet windows corresponding to each LED illuminant, thus, light sent out from each LED illuminant shoots out from the LED module from the respectively corresponding light inlet window.

To be specific, the said housing comprises a top cover, as well as side covers parallel to each other respectively connected to the bottom surface of the top cover.

More specifically, the said LED illumination device further comprises a light transmitting plate made of transparent material, which is arranged between the two side covers. The said housing further comprises two closure plates at both sides parallel to each other, where the closure plate at one side is connected to the same side end of the two side covers, while the closure plate at the other side is connected to the other same side end of the two side covers.

In addition, two positioning grooves are arranged respectively on the side face of the two side covers face to face, two side edges of the said light transmitting plate are respectively inserted into the said two positioning grooves, thus the light transmitting plate is plug-in mounted between the two side covers.

Meanwhile, the said LED illumination device further comprises two closure plates for the light transmitting plate which are constituted by a mutual perpendicularly connected plug board and closure plate. When the light transmitting plate is plug-in mounted between the two side covers, closure plates of the said light transmitting plate are plug-in mounted at both ends of the light transmitting plate by virtue of the plug boards inserted into the two positioning grooves. Thus, bottom of the housing is sealed by the plug boards of the two closure plates of the light transmitting plate together with the light transmitting plate, and both ends of the housing are sealed by the closure plates of the two closure plates of the light transmitting plate together with the closure plates at both sides.

For the convenience of installation and handling, the said LED illumination device further comprises two fixed supports respectively arranged at the lateral of the closure plates at both sides, thus the said LED illumination device can be held or installed by virtue of the two fixed supports.

The invention can also solve the said technical issues with the following technical proposals:

A method of controlling the LED module is proposed based on an LED illumination device capable of disassembling, assembling and combining modules and slidably adjusting locations of modules, the illumination device comprises a housing as well as at least one LED module installed in the housing. Interior of the said LED module is arranged with at least one LED illuminant. Interior of the said housing is arranged with at least one slideway. The said LED module is removably arranged in any location in any slideway, and can conduct sliding movement optionally in the said slideway. In particular, the said method comprises the following steps:

A. Fabricate a control unit, configure at least one electrode orbit 22 electrically connected to the said control unit for each slideway in the said housing, and the said control unit transfers control instruction respectively to each electrode orbit;

B. Prepare an illumination solution, set a control unit on the basis of the illumination solution, which shall transfer control instructions respectively to each electrode orbit; determine the electrode orbits in each slideway for each LED module to receive the control instruction based on the said illumination solution, and set at least one sliding contact electrode stretching out from the LED module, the said sliding contact electrodes along with the LED module where the sliding contact electrodes are located shall be corresponding to the electrode orbits receiving control instructions;

C. Install the LED module into the slideway where the said electrode orbits are located according to the electrode orbits for the LED module to receive control instructions, thus, enabling the electrode orbits for the LED module to receive control instructions to electrically contact with the sliding contact electrodes of the LED module, and ensuring that sliding contact electrodes of the LED module keep electric contact state with the said electrode orbits when the LED module is sliding in the slideway.

Compared with the prior art, technical effects of the invention "LED illumination device capable of disassembling, assembling, combining and slidably adjusting modules, and control method" are as follows:

1. By means of installing or disassembling LED modules in slideways, the invention is capable of realizing multiple illumination solutions of changing the luminance and illuminant color in a rapid way, thus the LED illumination device of the invention can be conveniently applied to various service environments and can be converted freely in the solutions applicable to various service environments;

2. Via the changeable control imposed by electrode orbits on each LED module, the invention enables the LED illumination device to realize multiple preset illumination solutions and reach the landscape lighting effect, thus, enabling appreciators to have colorful impressions.

MODE OF CARRYING OUT THE INVENTION MODEL

Figure 1:
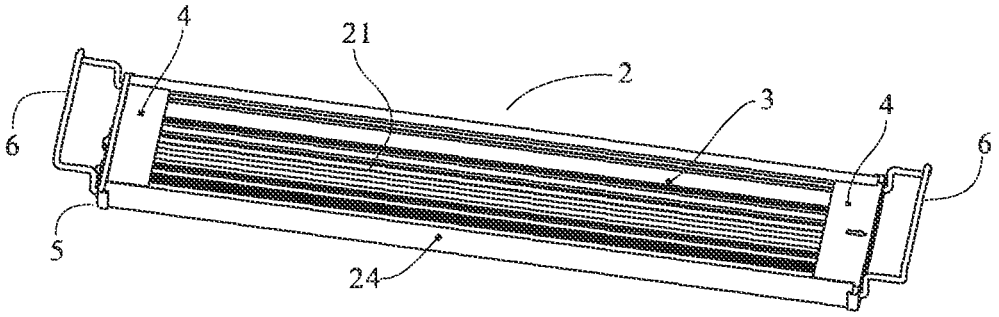
FIG. 1 shows an axonometric projection diagram of the preferred embodiment of the invention "LED illumination device capable of disassembling, assembling, combining and slidably adjusting modules, and control method"

To further illustrate the principle and structure of the invention, the invention is further described in detail in accordance with the preferable embodiments shown in the figures.

The invention proposes an LED illumination device capable of disassembling, assembling and combining modules and slidably adjusting locations of modules as is shown by FIG. 1 to FIG. 13, comprising a housing 2, as well as at least one LED module 1 installed in the said housing 2. Interior of the said LED module 1 is at least arranged with one LED illuminant 11. Interior of the said housing 2 is arranged with at least one slideway 21. The said LED module 1 is removably arranged in any location in any slideway, and can conduct sliding movement optionally in the said slideways. By means of installing or disassembling LED modules in slideways, the invention is capable of realizing multiple illumination solutions of changing the luminance and illuminant color in a rapid way, thus the LED illumination device of the invention can be conveniently applied to various service environments and can be converted freely in the solutions applicable to various service environments. Preferred embodiment in the invention takes the application of LED illumination device in aquatic breeding luminous environment as an example.

As to the preferred embodiment of the invention shown in FIG. 1, FIG. 2, FIG. 12 and FIG. 13, the said housing 2 comprises a top cover 21, as well as side covers 24 respectively connected to the bottom face of the top cover 23 parallel to each other.

Figure 2:
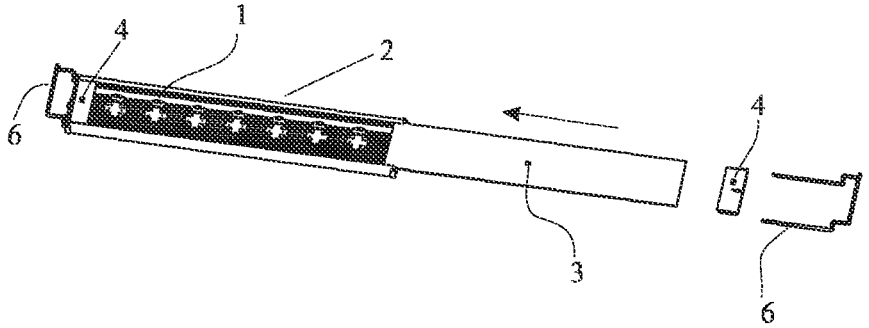
FIG. 2 shows an axonometric projection diagram of the said preferred embodiment at decomposed state.
Figure 3:
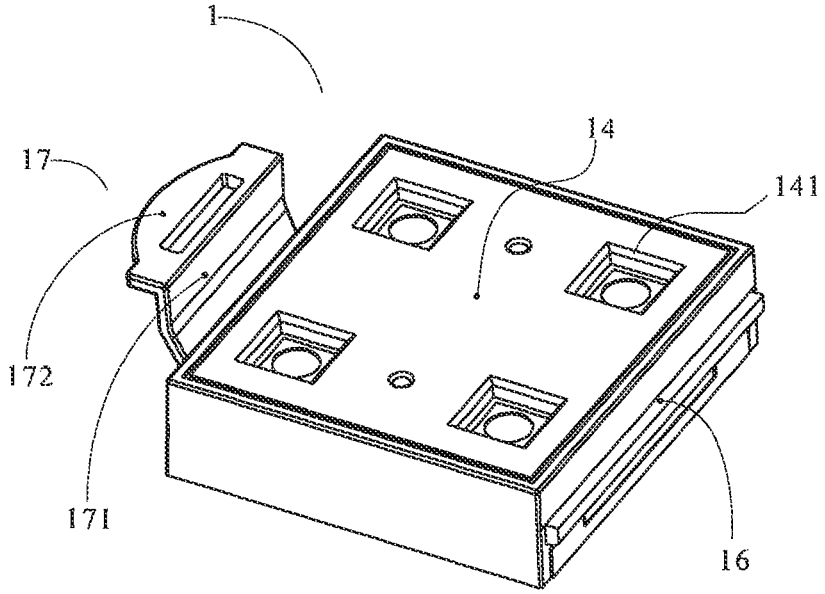
FIG. 3 shows an axonometric projection diagram of LED module 1 of the said preferred embodiment.

As to the preferred embodiment of the invention shown in FIG. 1 and FIG. 2, the said LED illumination device further comprises a light transmitting plate 3 made of transparent material, which is arranged between the two side covers 24. The said housing 2 further comprises two side closure plates 5 parallel to each other, where the closure plate 5 at one side is connected to the same side end of the two side covers 24, while the closure plate 5 at the other side is connected to the other same side end of the two side covers 24.

As to the preferred embodiment of the invention shown in FIG. 1, FIG. 2 and FIG. 5 to FIG. 7, two positioning grooves 241 are respectively arranged on the side face of the two side covers 24 face to face. Two side edges of the said light transmitting plate 3 are respectively inserted into the said two positioning grooves 241, thus enabling the light transmitting plate 3 to be plug-in mounted between the two side covers 24.

As to the preferred embodiment of the invention shown in FIG. 1, FIG. 2, FIG. 12 and FIG. 13, the said LED illumination device further comprises two closure plates 4 for the light transmitting plate which are constituted by a mutual perpendicular connected plug board 41 and closure plate 4. When the light transmitting plate 3 is plug-in mounted between the two side covers 24, closure plates 4 of the said light transmitting plate are plug-in mounted at both ends of the light transmitting plate 3 by virtue of the plug boards 41 inserted into the two positioning grooves 241. Thus, bottom of the housing 2 is sealed by the plug boards 41 of the two closure plates 4 of the light transmitting plate together with the light transmitting plate 3, and both ends of the housing 2 are sealed by the closure plates 42 of two closure plates 4 of the light transmitting plate together with the closure plates 5 at both sides.

As to the preferred embodiment of the invention shown in FIG. 1 and FIG. 2, for the convenience of installation and handling, the said LED illumination device further comprises two fixed supports 6 respectively arranged at the lateral of the closure plates 5 at both sides, thus the said LED illumination device can be held or installed by virtue of the two fixed supports 6.

To enable the LED module 1 to realize multiple preset illumination solutions, the invention proposes a method of controlling the LED module. Based on the above LED illumination device capable of disassembling, assembling and combining modules and slidably adjusting locations of modules shown by FIG. 1 to FIG. 13, namely, the illumination device comprises a housing 2, as well as at least one LED module 1 installed in the housing 2. Interior of the said LED module 1 is arranged with at least one LED illuminant 11. Interior of the said housing 2 is arranged with at least one slideway 21. The said LED module 1 is removably arranged in any location in any slideway 21, and can conduct sliding movement optionally in the said slideways 21. The said method comprises the following steps:

A. Fabricate a control unit, configure at least one electrode orbit 22 electrically connected to the said control unit for each slideway in the said housing 2, and the said control unit transfers control instruction respectively to each electrode orbit;

B. Prepare an illumination solution, set a control unit on the basis of the illumination solution, which shall transfer control instructions respectively to each electrode orbit 22; determine the electrode orbits 22 in each slideway for each LED module 1 to receive the control instruction based on the said illumination solution, and set at least one sliding contact electrode 12 stretching out from the LED module 1, the said sliding contact electrodes 12 along with the LED module 1 where the sliding contact electrodes 12 are located shall be corresponding to the electrode orbits 22 receiving control instructions;

C. Install the LED module 1 into the slideway 21 where the said electrode orbits 22 are located according to the electrode orbits 22 for the LED module 1 to receive control instructions, thus, enabling the electrode orbits 22 for the LED module 1 to receive control instructions to electrically contact with the sliding contact electrodes 22 of the LED module 1, and ensuring that sliding contact electrodes 12 of the LED module 1 keep electric contact state with the said electrode orbits 22 when the LED module 1 is sliding in the slideway 21.

The said illumination solution can be classified according to electrode orbits 22. For example, when one sliding contact electrode 12 of one LED module 1 is only electrically contacted with one electrode orbit 22, the first illumination solution can be realized; for the other example, when two sliding contact electrodes 12 of one LED module 1 are electrically contacted with two of the three electrode orbits 22, since there are three ways of combination as to the selection of two electrode orbits 22 from three electrode orbits 22, i.e., when two electrode orbits are selected from three electrode orbits 22 numbered x, y and z respectively, there will be three ways of combination of electrode orbit 22—(x, y), (x, z) and (x, y), therefore, when the two sliding contact electrodes 12 are electrically contacted with two of the three electrode orbits 22, the three illumination solutions can be realized respectively; for another example, when three sliding contact electrodes 12 of one LED module 1 are electrically contacted with three electrode orbits 22, one illumination solution can be realized as well. Therefore, by providing said LED module 1 with different numbers of sliding contact electrodes 12, the arrangement of various combinations of electrode orbits 22 for the slideways 21 achieves several control modes of lighting effect, including change of illuminance and light color, and different combinations of LED modules are selected to actualize significant lighting of a region.

In order to implement the above method, said housing 2 includes $N_i$ electrode orbits made of conducting material which are arranged for slideways respectively. Said $N_i$ represents the number of electrode orbits 22 arranged for the $i^{th}$ slideway 21; "i" represents the corresponding serial number allocated for slideways 21; $N_i$ is a natural number which is not less than 1. For example, "$N_2$=3" means that there are 3 electrode orbits 22 arranged for No. 2 slideway 21; "$N_5$=1" means that there is 1 electrode orbit 22 arranged for No. 5 slideway 21. That is, the number of electrode orbits 22 varies depending on different slideways 21 to which such electrode orbits 22 belong. Said LED module 1 is provided with "M" sliding contact electrodes 12 which are electrically connected to said LED illuminant 11, and "M" is a natural number which is not less than 1. That is, said LED module 1 could be provided with more than one sliding contact electrodes 12 as required by the illumination solution. In this case, the number of electrode orbits 22 required to be electrically contacted by said LED module 1 are determined according to the lighting effect to be achieved in said LED module 1, and said sliding contract electrode 12 corresponding to said electrode orbit 22 are installed accordingly. For example, according to the illumination solution, to achieve the lighting effect of said LED module 1, two electrode orbits 22 are required to be electrically contacted, and in this case, said LED module 1 is provided with a sliding contract electrode 12 with their locations corresponding to these two electrode orbits 22. Said sliding contact electrode 12 extends from said LED module 1. When said LED module 1 is installed in the $P^{th}$ slideway 21, "P" is a serial number of specific slideway, i.e. "P" is an element in a set with variable of "i". The sliding contact electrode 12 of said LED module 1 electrically contacts the electrode orbit 22 arranged for the $P^{th}$ slideway 21, and when said LED module 1 transitionally slides in said $P^{th}$ slideway 21, said sliding contact electrode 12 keeps electrically sliding contact along with said LED module 1 in said electrode orbit 21 arranged for the $P^{th}$ slideway 21.

The above structure comprises multiple setting-up solutions of electrode orbits 22 and multiple setting-up solutions of sliding contact electrodes 12. The invention is described in detail via a relatively simple solution, as is shown in FIG. 1 to FIG. 13. As to the preferred embodiment of the invention, a slideway 21 is arranged in the housing 2, and three electrode orbits 22 are configured for the slideway 21. As to the preferred embodiment of the invention shown in FIG. 5 to FIG. 7, LED module 1 of the two sliding contact electrodes 12 is adopted for main explanation, and the two sliding contact electrodes 12 are corresponding to the two electrode orbits 22 on the left among the three electrode orbits 22. In addition, as to the preferred embodiment of the invention shown in FIG. 9, LED module 1 of the three sliding contact electrodes 12 is described as well, and the three sliding contact electrodes 12 are respectively corresponding to the three electrode orbits 22.

The said electrode orbits 22 of the invention can be arranged on the inner face of the housing 2.

As to the preferred embodiment of the invention shown in FIG. 5 to FIG. 10, the said electrode orbits 22 can also be arranged in the slideway 21 where the electrode orbits 22 are located. In addition, the said electrode orbits 22 are arranged on the inner face of the housing 2.

The invention can not only transfer control instructions via electrode orbits 22, but can realize power supply to the LED module 1 when the LED module 1 is sliding in the slideway 21. The said LED illumination device further comprises a power supply unit providing electric energy, which is electrically connected to each electrode orbit 22, so as to provide electric energy to each LED module 1. On the above basis, to control the LED module 1, the said LED module 1 further comprises a sub control module, which receives and dispatches control instruction data to each LED illuminant 11 in the LED module 1.

Preferred embodiment of the invention uses electrode orbits 22 to transfer electric energy and control signals simultaneously. The said LED illumination device further comprises a power supply unit providing electric energy, as well as a control unit controlling each LED module 1. The said electrode orbits 22 are electrically connected to the said power supply unit and control unit, where the former provides electric energy to each LED module 1 by virtue of electrode orbits 22, while the latter receives and dispatches control instruction data towards each LED module 1.

Figure 4:
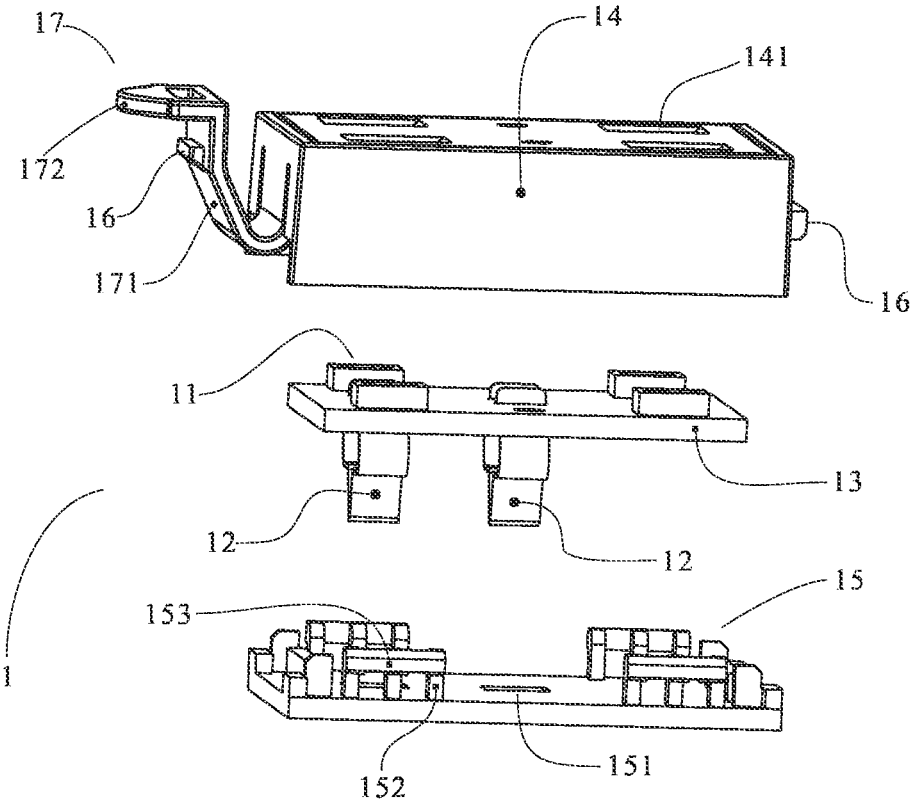
FIG. 4 shows an axonometric projection diagram of LED module 1 of the said preferred embodiment at decomposed state.

As to the preferred embodiment of the invention shown in FIG. 4, the said LED module 1 further comprises a printed circuit board 13, both the LED illuminants 11 and sliding contact electrodes 12 of the LED module 1 are electrically connected to the said printed circuit board 13.

As to the preferred embodiment of the invention shown in FIG. 4, the said LED module 1 further comprises a module lampshade 14 and a module backboard 15. The said printed circuit board 13 is fixedly mounted to the module backboard (15); the said module lampshade (14) covers and is connected to the module backboard 15. The said sliding contact electrodes 12 stretch out of the LED module 1 from the module backboard 15 by virtue of the electrode through hole 151 on the module backboard 15.

To enable the module backboard 15 to be connected to the module lampshade 14, in the preferred embodiment of the invention, top face of the said module backboard 15 is arranged with at least one connecting bracket 152, and top of the connecting bracket 152 is arranged with a latch hook 153 which stretches out from the outside face of the connecting bracket 152. Inner wall of the said module lampshade 14 is arranged with straight lock tongues whose quantity is the same with that of the connecting bracket 152. The said connecting bracket 152 is flexibly connected to the module backboard 15, or the said connecting bracket 152 is made of elastic material. When the module lampshade 14 covers the module backboard 15, the latch hooks 153 and lock tongues of the corresponding positions are buckled together under the action of elastic restoring force, thus the module lampshade 14 is connected to the module backboard 15.

As the specific way of emitting light from the LED module, in the preferred embodiment of the invention shown in FIG. 4, the said module lampshade 14 is arranged with light inlet windows 141 corresponding to the position of each LED illuminant 11, thus, light sent out from each LED illuminant 11 shoots out from the LED module from the respectively corresponding light inlet window 141.

As to the preferred embodiment of the invention shown in FIG. 4 to FIG. 10, the said slideway 21 comprises two slideway vertical walls 211 parallel to each other. The slideway vertical wall 211 is arranged with a concave chute 212. Notch of the respective chute 212 of the two slideway vertical walls 211 are arranged face to face. The said LED module 1 is arranged with two straight flanges 16 protruding out from the outer wall of the LED module 1, and the two flanges 16 are parallel to each other. The said two flanges 16 are arranged respectively corresponding to the said chutes 212, enabling the LED module 1 to be removably loaded into the slideway 21 by virtue of the two flanges 16 clamped into the two chutes 212, and enabling the LED module 1 to slidably shift in the slideway 21 by virtue of the two flanges 16 sliding in the two chutes 212.

As to the preferred embodiment of the invention shown in FIG. 5 to FIG. 10, both the said two slideway vertical walls 211 are connected to the inner face of the housing 2.

The said LED module 1 of the invention further comprises a module backboard 15, as well as a module lampshade 14 covering and is connected to the module backboard 15. The said two flanges 16 are respectively arranged at the two sides of the module lampshade 14.

As to the preferred embodiment of the invention shown in FIG. 4, the said LED module 1 further comprises a module backboard 15, a module lampshade 14 covering and is connected to the module backboard 15, as well as a handle 17. The said handle 17 is flexibly connected to the said module lampshade 14 or the said handle 17 is made of flexible material. One flange 16 is arranged at the lateral surface of the handle 17, while the other flange 16 is arranged at the side face of the module lampshade 14, and the two flanges 16 are ensured to be parallel to each other. The LED module 1 is removably mounted into the slideway 21 by virtue of the elastic restoring force acting on the handle, as well as the two flanges 16 that can be respectively clamped into the two chutes 212.

Figure 5:
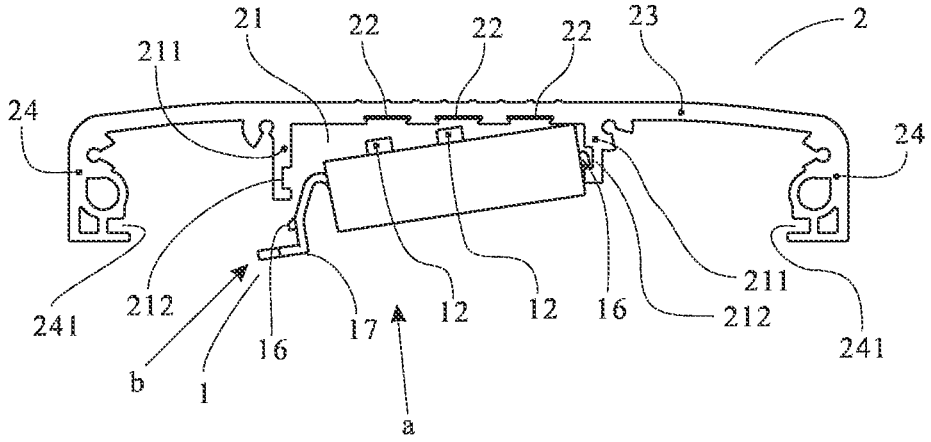
FIG. 5 shows an orthographic projection right side view of LED module 1 with double sliding contact electrodes 12 of the said preferred embodiment when assembled to housing 2.
Figure 6:
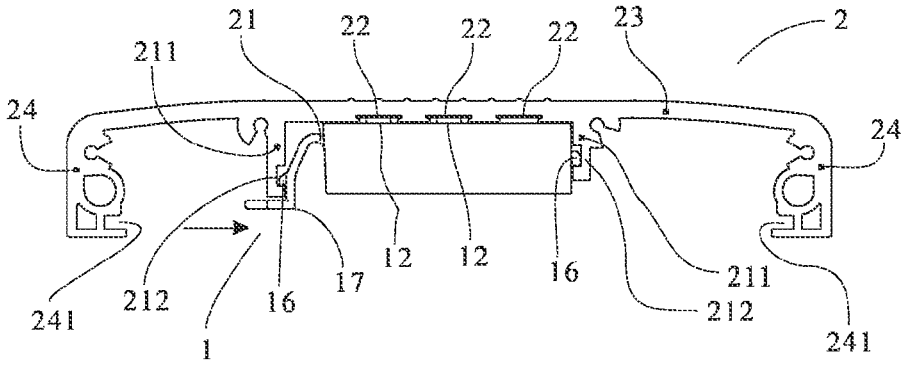
FIG. 6 shows an orthographic projection right side view of housing 2 assembled with LED module 1 of the said preferred embodiment.
Figure 7:
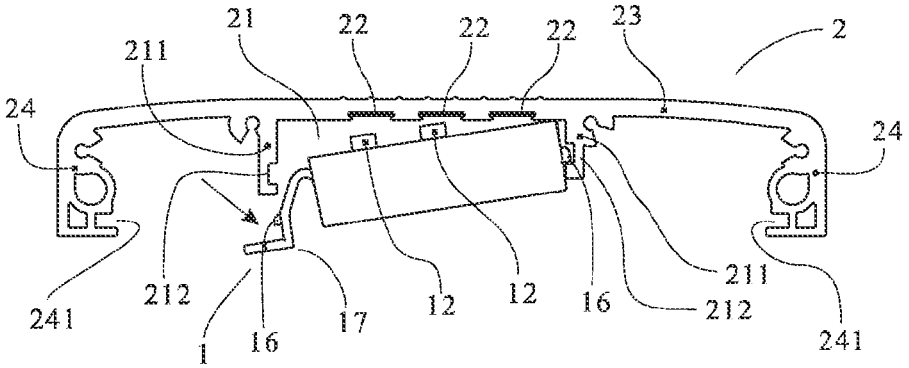
FIG. 7 shows an orthographic projection right side view of LED module 1 of the said preferred embodiment when dismounted from housing 2.
Figure 8:
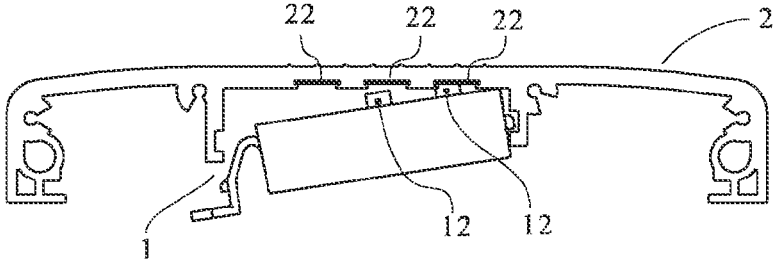
FIG. 8 shows an orthographic projection right side view of another LED module 1 with double sliding contact electrodes 12 of the said preferred embodiment when assembled to housing 2.
Figure 9:
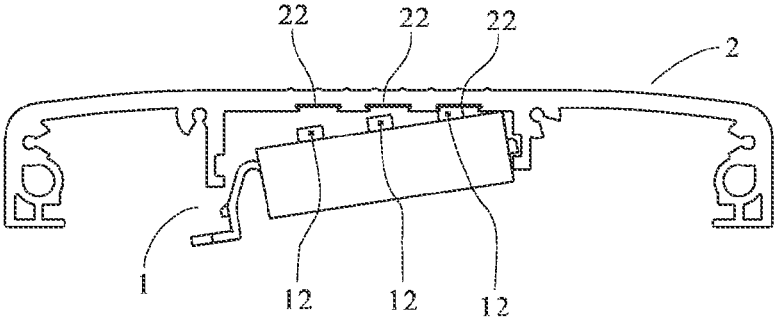
FIG. 9 shows an orthographic projection right side view of LED module 1 with three sliding contact electrodes 12 of the said preferred embodiment when assembled to housing 2.
Figure 10:
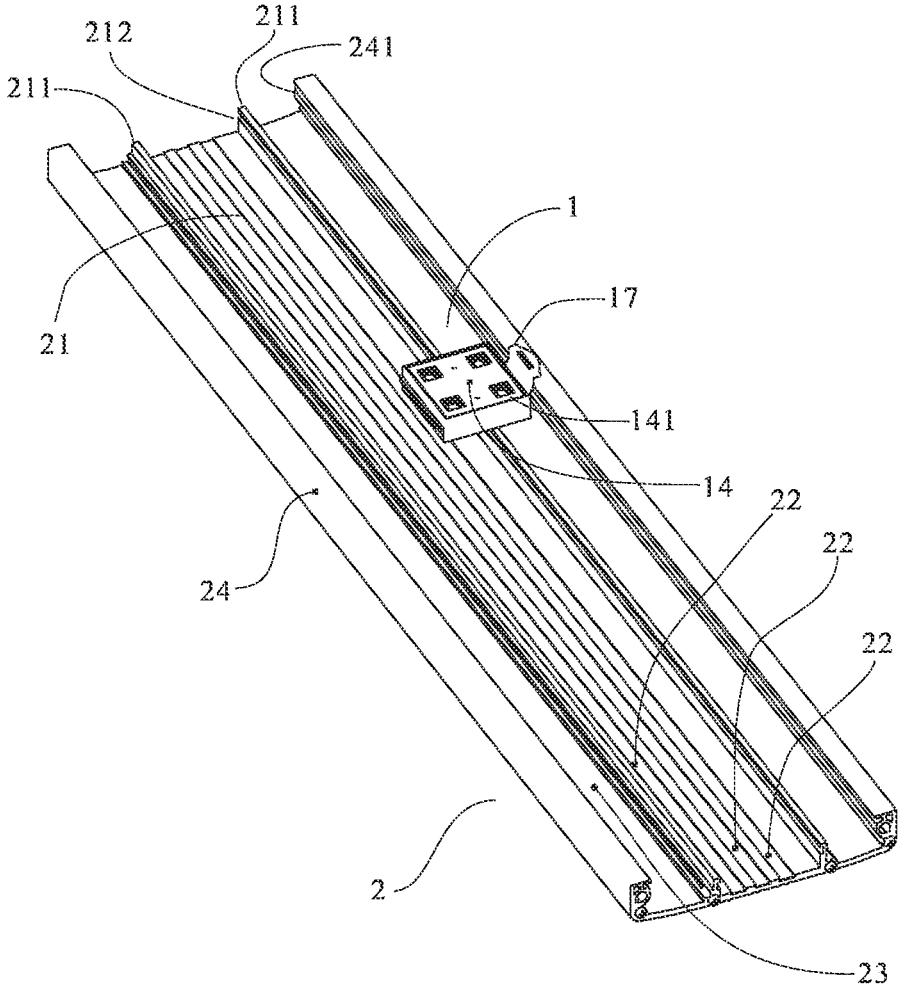
FIG. 10 shows an axonometric projection diagram of LED module 1 and housing 2 of the said preferred embodiment at decomposed state.
Figure 11:
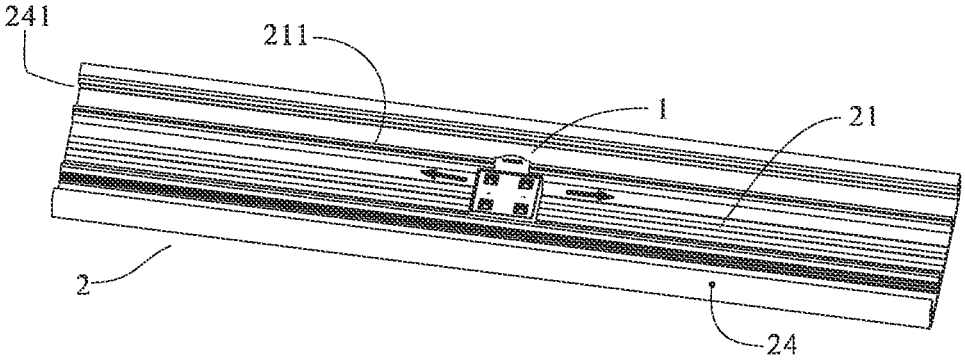
FIG. 11 shows an axonometric projection diagram of housing 2 installed with one LED module 1 of the said preferred embodiment at decomposed state.
Figure 12:
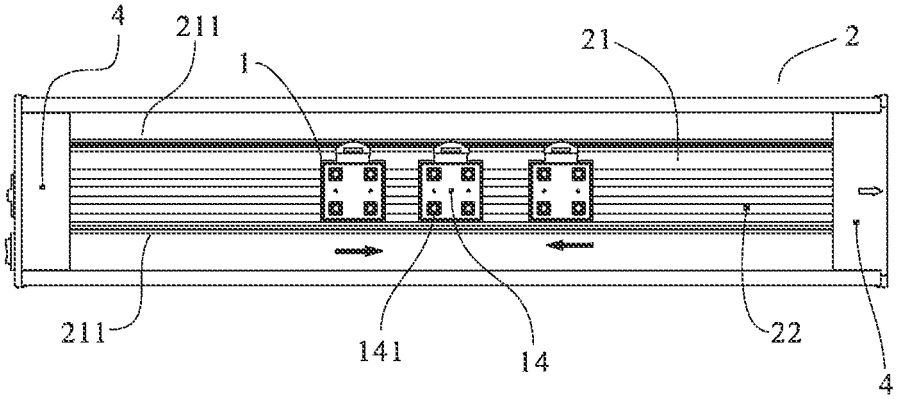
FIG. 12 shows an orthographic projection upward view of housing 2 installed with three LED modules 1 of the said preferred embodiment.
Figure 13:
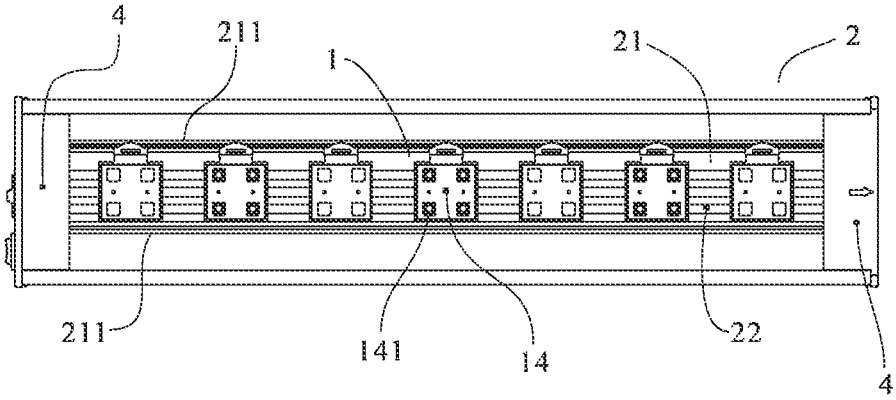
FIG. 13 shows an orthographic projection upward view of housing 2 installed with five LED modules 1 of the said preferred embodiment.

As to the preferred embodiment of the invention shown in FIG. 4, the said handle 17 comprises an elastic action handle 171 of curved surface and a planar handheld face 172. One side edge of the said elastic action handle 171 is connected to the module lampshade 14, while the other side edge of the elastic action handle 171 is connected to the said handheld face 172. One flange 16 of the said two flanges 16 parallel to each other is arranged at the side face of the elastic action handle 171 facing outside of the LED module 1. The said elastic action handle 171 is flexibly connected to the said module lampshade 14, or the said elastic action handle 171 is made of elastic material. Thus, when the LED module 1 is disassembled and assembled in the slideway 21, the flange 16 arranged on the elastic action handle 171 can be displaced flexibly, restorably and back and forth between the module lampshade 14 and slideway vertical walls 211. As is shown in FIG. 5, first of all, place one flange 16 on the module lampshade 14 into one chute 212, clamp the flange 16 on the elastic action handle 171 into the other chute 212 via the direction indicated by arrow a and b, thus, LED module 1 is loaded into the slideway 21 of the housing 2, as is shown in FIG. 6. Press the handle 17 as per the direction indicated by the arrow in FIG. 6, enabling the flange 16 on the elastic action handle 171 to exit from the chute 212, and enabling the LED module 1 to be removed from slideway 21 of the housing 2 as per the direction indicated by FIG. 7.

As to the preferred embodiment of the invention shown in FIG. 4, to enable the module backboard to be connected to the module lampshade 14, top face of the said module backboard 15 is arranged with at least one connecting bracket 152, top of the connecting bracket 152 is arranged with a latch hook 153 which stretches out from the outside face of the connecting bracket 152. Inner wall of the said module lampshade 14 is arranged with straight lock tongues whose quantity is the same with that of the connecting bracket 152. The said connecting bracket 152 is flexibly connected to the module backboard 15, or the said connecting bracket 152 is made of elastic material. When the module lampshade 14 covers the module backboard 15, the latch hooks 153 and lock tongues of the corresponding positions are buckled together under the action of elastic restoring force, thus the module lampshade 14 is connected to the module backboard 15.

As to the preferred embodiment of the invention shown in FIG. 4, as the specific way of emitting light from the LED module, the said module lampshade 14 is arranged with light inlet windows corresponding to the position of each LED illuminant 11, thus, light sent out from each LED illuminant 11 shoots out from the LED module 1 from the respectively corresponding light inlet window 141.

What is claimed is:

1. An LED illumination device capable of disassembling, assembling and combining modules and slidably adjusting locations of modules; characterized in that:

it comprises a housing, as well as at least one LED module installed in housing; interior of the said LED module is arranged with at least one LED illuminant;

interior of the said housing is arranged with at least one slideway; the said LED module is removably arranged in any location in any slideway, and can conduct sliding movement optionally in the said slideway;

the said slideway comprises two slideway vertical walls parallel to each other; the slideway vertical wall is arranged with a concave chute; notch of the respective chute of the two slideway vertical walls are arranged face to face;

the said LED module is arranged with two straight flanges protruding out from the outer wall of the LED module, and the two straight flanges are parallel to each other;

the said two straight flanges are arranged respectively corresponding to the said chutes, enabling the LED module to be removably loaded into the slideway by virtue of the two flanges clamped into the two chutes, and enabling the LED module to slidably shift in the slideway by virtue of the two flanges sliding in the two chutes;

the said LED module further comprises a module backboard, a module lampshade covering and is connected to the module backboard, as well as a handle; the said handle is flexibly connected to the said module lampshade or the said handle is made of flexible material; one flange is arranged at the lateral surface of the handle, while the other flange is arranged at the side face of the module lampshade, and the two flanges are ensured to be parallel to each other; LED module is removably mounted into the slideway by virtue of the elastic restoring force acting on the handle, as well as the two flanges that can be respectively clamped into the two chutes.

2. The LED illumination device capable of disassembling, assembling and combining modules and slidably adjusting locations of modules according to claim 1 is characterized in that:

the said housing comprises $N_i$ electrode orbits made of conducting material configured respectively for each slideway; the said $N_i$ represents the quantity of electrode orbits configured for the $i^{th}$ slideway, i is the corresponding slideway serial number allocated for each slideway, and Ni is the natural number no smaller than 1;

the said LED module is arranged with M sliding contact electrodes which are electrically connected to the LED luminescent lamp body, M is the natural number no smaller than 1; and the said sliding contact electrodes stretch out from the LED module;

when the LED module is installed in the $P^{th}$ slideway, P is the serial number of a specific slideway, sliding contact electrodes of the LED module are electrically contacted with the electrode orbits configured for the $P^{th}$ slideway; In addition, when the LED module conducts sliding movement in the said $P^{th}$ slideway, the said sliding contact electrodes also maintain electrically contacted sliding movement on the said corresponding electrode orbits configured for the $P^{th}$ slideway along with the LED module.

3. The LED illumination device capable of disassembling, assembling and combining modules and slidably adjusting locations of modules according to claim 2 is characterized in that:

the said electrode orbits are arranged on the inner face of the housing.

4. The LED illumination device capable of disassembling, assembling and combining modules and slidably adjusting locations of modules according to claim 2 is characterized in that:

the said electrode orbits are arranged in the slideway where the electrode orbits are located.

5. The LED illumination device capable of disassembling, assembling and combining modules and slidably adjusting locations of modules according to claim 4 is characterized in that:

the said electrode orbits are arranged on the inner face of the housing.

6. The LED illumination device capable of disassembling, assembling and combining modules and slidably adjusting locations of modules according to claim 2 is characterized in that:

it further comprises a power supply unit providing electric energy, and the power supply unit is electrically connected to each electrode orbit, so as to provide electric energy to each LED module.

7. The LED illumination device capable of disassembling, assembling and combining modules and slidably adjusting locations of modules according to claim 6 is characterized in that:

the said LED module further comprises a sub control module, which receives and dispatches control instruction data towards each LED illuminant in the LED module.

8. The LED illumination device capable of disassembling, assembling and combining modules and slidably adjusting locations of modules according to claim 2 is characterized in that:

it further comprises a power supply unit providing electric energy, as well as a control unit controlling each LED module; the said electrode orbits are electrically connected to the said power supply unit and control unit, where the former provides electric energy to each LED module by virtue of electrode orbits, while the latter receives and dispatches control instruction data towards each LED module.

9. The LED illumination device capable of disassembling, assembling and combining modules and slidably adjusting locations of modules according to claim 2 is characterized in that:

the said LED module further comprises a printed circuit board, both the LED illuminants and sliding contact electrodes of the LED module are electrically connected to the said printed circuit board.

10. The LED illumination device capable of disassembling, assembling and combining modules and slidably adjusting locations of modules according to claim 9 is characterized in that:

the said LED module further comprises a module lampshade and a module backboard; the said printed circuit board is fixedly mounted to the module backboard; the said module lampshade covers and is connected to the module backboard; the said sliding contact electrodes stretch out of the LED module from the module backboard by virtue of the electrode through hole on the module backboard.

11. The LED illumination device capable of disassembling, assembling and combining modules and slidably adjusting locations of modules according to claim 10 is characterized in that:

top face of the said module backboard is arranged with at least one connecting bracket, and top of the connecting bracket is arranged with a latch hook which stretches out from the outside face of the connecting bracket; inner wall of the said module lampshade is arranged with straight lock tongues whose quantity is the same with that of the connecting bracket;

the said connecting bracket is flexibly connected to the module backboard, or the said connecting bracket is made of elastic material; When the module lampshade covers the module backboard, the latch hooks and lock tongues of the corresponding positions are buckled together under the action of elastic restoring force, thus the module lampshade is connected to the module backboard.

12. The LED illumination device capable of disassembling, assembling and combining modules and slidably adjusting locations of modules according to claim 1 is characterized in that:

the said handle comprises an elastic action handle of curved surface and a planar handheld face; one side edge of the said elastic action handle is connected to the module lampshade, while the other side edge of the elastic action handle is connected to the said handheld face; one flange of the said two flanges parallel to each other is arranged at the side face of the elastic action handle facing outside of the LED module; the said elastic action handle is flexibly connected to the said module lampshade, or the said elastic action handle is made of elastic material; Thus, when the LED module is disassembled and assembled in the slideway, the flange arranged on the elastic action handle can be displaced flexibly, restorably and back and forth between the module lampshade and slideway vertical walls.

13. The LED illumination device capable of disassembling, assembling and combining modules and slidably adjusting locations of modules according to claim is characterized in that:

top face of the said module backboard is arranged with at least one connecting bracket, and top of the connecting bracket is arranged with a latch hook which stretches out from the outside face of the connecting bracket; inner wall of the said module lampshade is arranged with straight lock tongues whose quantity is the same with that of the connecting bracket;

the said connecting bracket is flexibly connected to the module backboard, or the said connecting bracket is made of elastic material; When the module lampshade covers the module backboard, the latch hooks and lock tongues of the corresponding positions are buckled together under the action of elastic restoring force, thus the module lampshade is connected to the module backboard.

14. The LED illumination device capable of disassembling, assembling and combining modules and slidably adjusting locations of modules according to claim is characterized in that:

the said module lampshade is arranged with light inlet windows corresponding to the position of each LED illuminant, thus, light sent out from each LED illuminant shoots out from the LED module from the respectively corresponding light inlet window.

15. The LED illumination device capable of disassembling, assembling and combining modules and slidably adjusting locations of modules according to claim 1 is characterized in that:

the said housing comprises a top cover, as well as side covers respectively connected to the bottom surface of the top cover parallel to each other.

16. The LED illumination device capable of disassembling, assembling and combining modules and slidably adjusting locations of modules according to claim 15 is characterized in that:

it further comprises a light transmitting plate made of transparent material, which is arranged between the two side covers; the said housing further comprises two closure plates at both sides parallel to each other, where the closure plate at one side is connected to the same side end of the two side covers, while the closure plate at the other side is connected to the other same side end of the two side covers.

17. The LED illumination device capable of disassembling, assembling and combining modules and slidably adjusting locations of modules according to claim 16 is characterized in that:

two positioning grooves are arranged respectively on the side face of the two side covers face to face, two side edges of the said light transmitting plate are respectively inserted into the said two positioning grooves; thus, the light transmitting plate is plug-in mounted between the two side covers.

18. The LED illumination device capable of disassembling, assembling and combining modules and slidably adjusting locations of modules according to claim 17 is characterized in that:

it further comprises two closure plates for the light transmitting plate which are constituted by a mutual perpendicularly connected plug board and closure plate when the light transmitting plate is plug-in mounted between the two side covers, closure plates of the said light transmitting plate are plug-in mounted at both ends of the light transmitting plate by virtue of the plug boards inserted into the two positioning grooves; thus, bottom of the housing is sealed by the plug boards of the two closure plates of the light transmitting plate together with the light transmitting plate, and both ends of the housing are sealed by the closure plates of the two closure plates of the light transmitting plate together with the closure plates at both sides.

19. The LED illumination device capable of disassembling, assembling and combining modules and slidably adjusting locations of modules according to claim 17 is characterized in that:

it further comprises two fixed supports respectively arranged at the lateral of the closure plates at both sides, thus the said LED illumination device can be held or installed by virtue of the two fixed supports.

20. A method of controlling the LED module is proposed based on the LED illumination device capable of disassembling, assembling and combining modules and slidably adjusting locations of modules, the illumination device comprises a housing as well as at least one LED module installed in the housing; interior of the said LED module is arranged with at least one LED illuminant; interior of the said housing is arranged with at least one slideway; the said LED module is removably arranged in any location in any slideway, and can conduct sliding movement optionally in the said slideway; featuring that, the said method comprises the following steps:

A. fabricate a control unit, configure at least one electrode orbit electrically connected to the said control unit for each slideway in the said housing, and the said control unit transfers control instruction respectively to each electrode orbit;

B. prepare an illumination solution, set a control unit on the basis of the illumination solution, which shall transfer control instructions respectively to each electrode orbit; determine the electrode orbits in each slideway for each LED module to receive the control instruction based on the said illumination solution, and set at least one sliding contact electrode stretching out from the LED module, the said sliding contact electrodes along with the LED module where the sliding contact electrodes are located shall be corresponding to the electrode orbits receiving control instructions;

C. install the LED module into the slideway where the said electrode orbits are located according to the electrode orbits for the LED module to receive control instructions, thus, enabling the electrode orbits for the LED module to receive control instructions to electrically contact with the sliding contact electrodes of the LED module, and ensuring that sliding contact electrodes of the LED module keep electric contact state with the said electrode orbits when the LED module is sliding in the slideway.

* * * * *